US005654732A

United States Patent [19]

Katakura

[11] Patent Number: 5,654,732

[45] Date of Patent: Aug. 5, 1997

[54] DISPLAY APPARATUS

[75] Inventor: Kazunori Katakura, Atsugi, Japan

[73] Assignee: Canon Kabushiki Kaisha, Tokyo, Japan

[21] Appl. No.: 367,772

[22] Filed: Jan. 3, 1995

Related U.S. Application Data

[63] Continuation of Ser. No. 916,623, Jul. 22, 1992, abandoned.

[30] Foreign Application Priority Data

Jul. 24, 1991 [JP] Japan ..... 3-206188
Jul. 24, 1991 [JP] Japan ..... 3-206189

[51] Int. Cl.[6] ..... G09G 3/36

[52] U.S. Cl. ..... 345/95; 345/96; 345/103; 345/149

[58] Field of Search ..... 345/89, 87, 103, 345/147, 149, 152, 43, 94, 100, 101, 95, 96, 208, 209, 210; 359/54, 55, 56

[56] References Cited

U.S. PATENT DOCUMENTS

| | | | |
|---|---|---|---|
| 4,661,809 | 4/1987 | Anderson et al. | 345/149 |
| 4,705,345 | 11/1987 | Ayliffe | 340/784 |
| 4,791,417 | 12/1988 | Bobak | 340/793 |
| 5,128,663 | 7/1992 | Coulson | 340/793 |
| 5,404,236 | 4/1995 | Hartmann et al. | 345/149 |
| 5,408,246 | 4/1995 | Inaba et al. | 345/89 |

FOREIGN PATENT DOCUMENTS

| | | |
|---|---|---|
| 0158366 | 10/1985 | European Pat. Off. . |
| 0469531 | 2/1992 | European Pat. Off. . |
| 61-94023 | 5/1986 | Japan . |
| 373127 | 3/1991 | Japan . |

OTHER PUBLICATIONS

N.A. Clark, et al., "Ferroelectric Liquid Crystal Electro–Optics Using the Surface Stabilized Structure", Molecular Crystals and Liquid Crystals, vol. 94, Nos. 1 and 2, pp. 213–233 (1983).

*Primary Examiner*—Xiao Wu
*Attorney, Agent, or Firm*—Fitzpatrick, Cella, Harper & Scinto

[57] ABSTRACT

A display apparatus comprises a display section having a multiplicity of pixels $P_1$, $P_2$, each pixel having first and second bi-stable sub-pixels A, B and A', B' which have the same threshold characteristics, and a driver for driving the pixels in such a manner that a first writing pulse $A_1$ is applied to the first sub-pixel A, A' so as to write a complete first stable state in the first sub-pixel A, A', followed by application of a second writing pulse $A_2$ to write the second stable state, while a first writing pulse $B_1$ is applied to the second sub-pixel B,B' to write a complete second stable state in the second sub-pixel B,B', followed by application of a second writing pulse $B_2$ to write the first stable state.

3 Claims, 10 Drawing Sheets

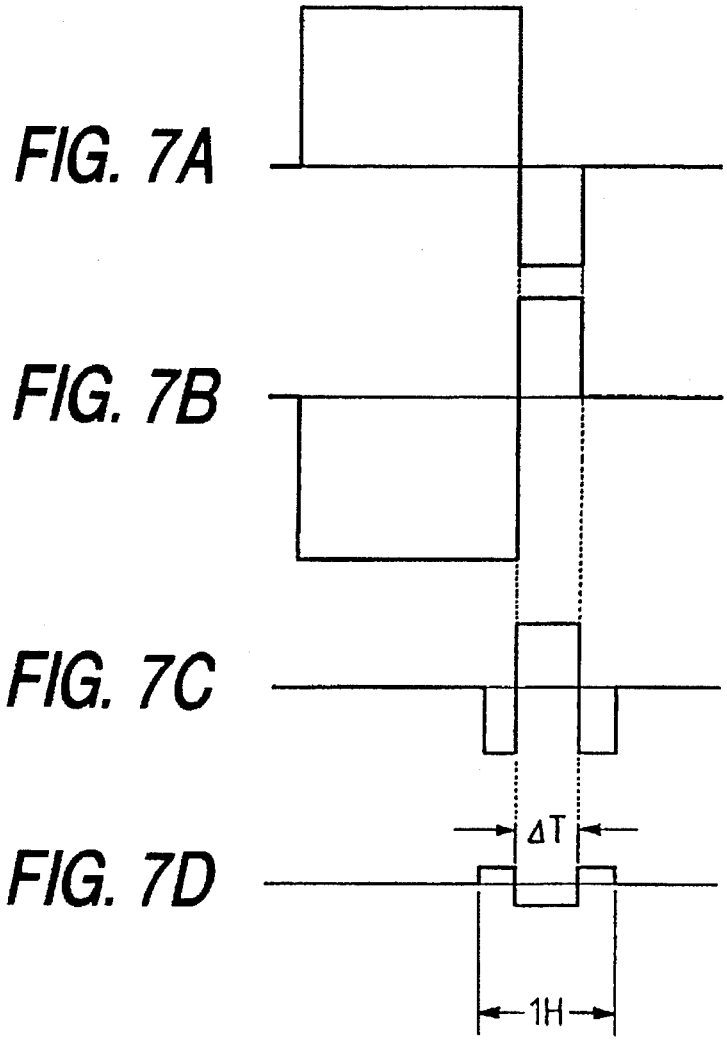
FIG. 8
PRIOR ART
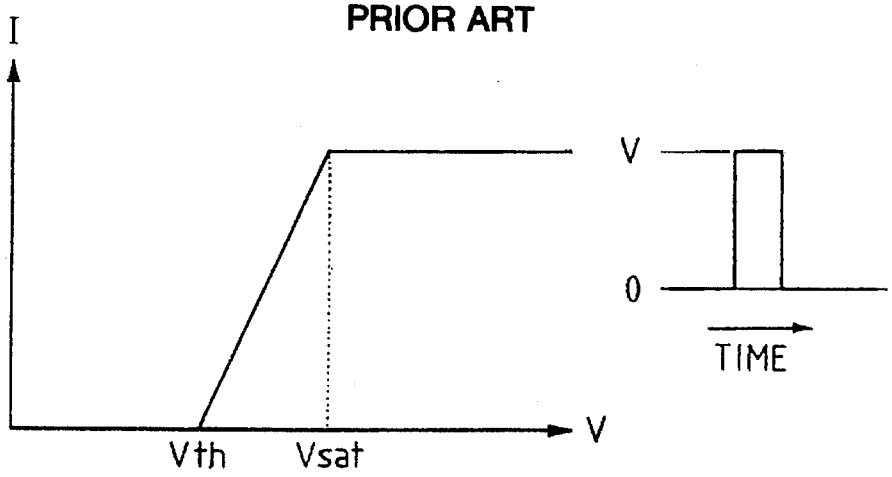

FIG. 9A
PRIOR ART
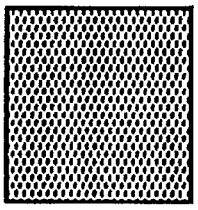
V=0
FIG. 9B
PRIOR ART
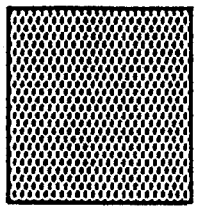
V < Vth
FIG. 9C
PRIOR ART
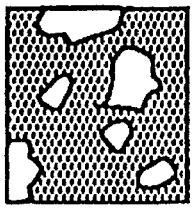
Vth< V < Vsat
FIG. 9D
PRIOR ART
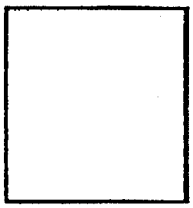
Vsat < V
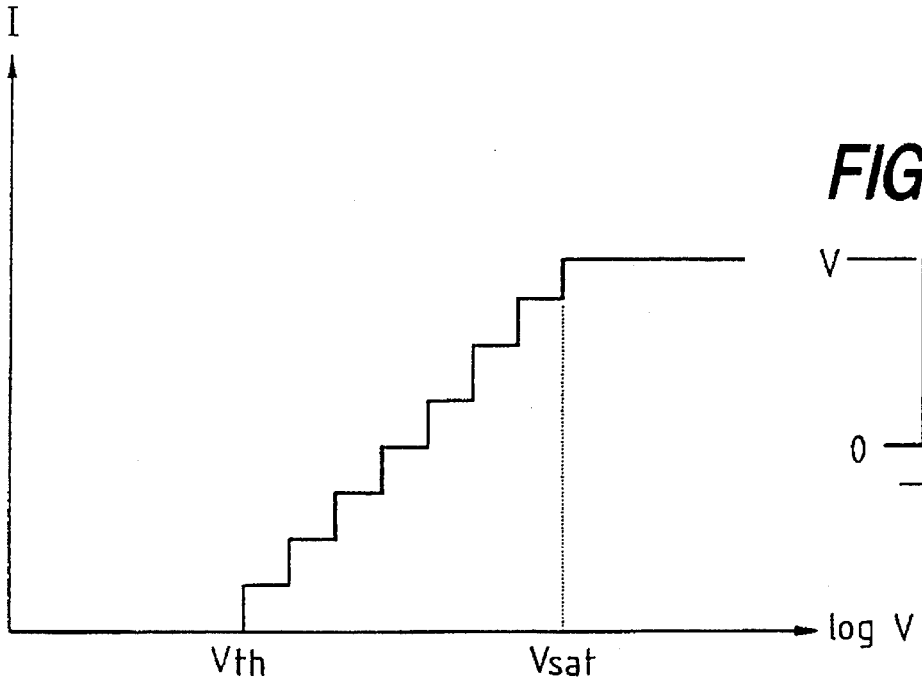
FIG. 10A
FIG. 10B
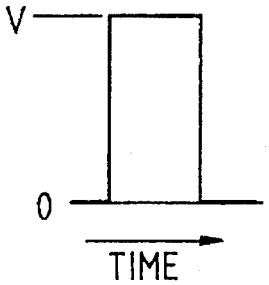

DISPLAY APPARATUS

This application is a continuation of application Ser. No. 07/916,623, filed Jul. 22, 1992, now abandoned.

BACKGROUND OF THE INVENTION

1. Field of the Invention

The present invention relates to a display apparatus which performs a gradation display by using a bi-stable display device.

2. Related Background Art

Hitherto, a liquid crystal display apparatus has been known which performs a gradation display by using a ferroelectric liquid crystal (FLC) as a bi-stable display device.

An example of the display device of the kind described above is disclosed in Japanese Patent Appln. Laid-Open No. 61-94023. This known display device has a liquid crystal cell composed of a pair of alignment-treated glass substrates which are arranged to oppose each other leaving a gap of 1 to 3 microns therebetween and which are provided on their inner surfaces with transparent electrodes, the gap between the glass substrates being filled with a ferroelectric liquid crystal.

The display device employing a ferroelectric liquid crystal has the following advantages. Firstly, ferroelectric liquid crystal has spontaneous polarization so that a composite force composed of a force given by an external electric field and a force developed as a result of the spontaneous polarization can be used as the switching force. Secondly, since the direction of longer axis of the molecules of the liquid crystal coincides with the direction of the spontaneous polarization, the liquid crystal display device can be switched by the polarity of an external electric field.

In general, chiral smectic liquid crystal (SmC*, SmH*) is used as the ferroelectric liquid crystal. This type of ferroelectric liquid crystal in a bulk state exhibits such an orientation that the longer axes of the liquid crystal molecules are twisted. Such a twisting tendency, however, can be eliminated when the liquid crystal is charged in the gap of 1 to 3 microns in the liquid crystal cell (see P213–234, N. A. Clark et al., MCLC: 1983. Vol. Vol 194).

FIGS. 11A and 11B show a typical known ferroelectric liquid crystal cell having a simple matrix substrate structure.

Typically, a ferroelectric liquid crystal is used with its two stable states set to light-transmitting and light-interrupting states, respectively, so as to perform a binary display, e.g., display of black and white images. The ferroelectric liquid crystal display device, however, can be used for display of multi-level or halftone images. One of the methods for effecting such halftone image display is to create an intermediate light-transmitting state by the control of the ratio between the two stable states within a single pixel. A detailed description will be given of this method which is known as the area modulation method.

FIG. 8 is a schematic illustration of the relationship between the light transmissivity of a ferroelectric liquid crystal device and the amplitude of a switching pulse applied to the device. More specifically, a single shot of pulse of a given polarity was applied to the cell (device) which was initially in a complete light-interrupting (black) state so as to change the light-transmissivity of the cell. The light-transmissivity after the application of the single shot of pulse varies according to the amplitude of the pulse. The light-transmissivity I was plotted as a function of the pulse amplitude V, thus, obtaining the curve shown in FIG. 8. The light-transmissivity of the cell is not changed when the amplitude V of the pulse applied is below the threshold value $V_{th}$($V<V_{th}$) so that the state of light transmission 9(*b*) is the same as that shown in FIG. 9(*a*) obtained in the state before the application of the pulse. When the pulse amplitude is increased beyond the threshold value ($V_{th}<V<V_{sat}$), portions of the liquid crystal in the pixel are switched to the other stable state, i.e., to the light-transmitting state, as shown in FIG. 9(*c*), so that the pixel exhibits an intermediate level of light transmission. As the pulse amplitude is further increased to exceed the threshold level ($V_{sat}<V$), the entire portion of the pixel is switched to light-transmitting state, thus achieving a constant light transmissivity.

According to the area modulation method, it is thus possible to display halftone image by controlling the amplitude of the pulse V within the range expressed by $V_{th}<V<V_{sat}$.

A stable analog gradation display could be performed despite any variation in the threshold characteristics in the display area due to variation in temperature or cell thickness, by using the described area modulation method in combination with a driving method which is disclosed, for example, in the specification of Japanese Patent Application No. 3-73127 of the same applicant. This driving method will be referred to as "driving method of prior application" hereinafter.

The driving method of the prior application, however, essentially requires that four writing pulses and auxiliary pulses assisting these writing pulses are used for each pixel, in order to compensate for any fluctuation in the threshold characteristics in the display area. Consequently, an impractically long time, which is about 10 times as long as that required for conventional monochromatic binary display, is required for writing information in the display area.

SUMMARY OF THE INVENTION

Accordingly, an object of the present invention is to provide a display apparatus which can perform a prompt display of an image with gradation, while compensating for any variation in the threshold value within the display area attributable to fluctuation in the temperature and cell thickness in the display area.

To this end, according to one aspect of the present invention, there is provided a display apparatus in which each of the pixels is composed of first and second bi-stable sub-pixels having the same threshold characteristics. When the apparatus is driven, a first writing pulse is applied to the first sub-pixel so as to completely set it to the first stable state, followed by application of a second writing pulse to write the second stable state in the first sub-pixel, while a first writing pulse is applied to the second sub-pixel to completely set it into the second stable state followed by application of a second writing pulse to write the first stable state in the second sub-pixel.

According to another aspect, the display apparatus employs a multiplicity of pixels each of which is composed of first and second bi-stable sub-pixels having the same threshold characteristics. When the apparatus is driven, a first writing pulse is applied to the first sub-pixel so as to completely set it to the first stable state, followed by application of a second and subsequent writing pulses to alternately write the second stable state and the first stable state in the first sub-pixel, while a first writing pulse is applied to the second sub-pixel to completely set it into the second stable state followed by application of a second and subsequent writing pulses to alternately write the first stable state and the second stable state in the second sub-pixel.

BRIEF DESCRIPTION OF THE DRAWINGS

FIGS. 7(*a*) to 7(*d*) are signal charts showing the waveforms of driving signals employed in the embodiment shown in FIG. 6;

FIG. 8 is a schematic illustration of the relationship between the light transmissivity exhibited by a ferroelectric liquid crystal and the amplitude of a switching pulse applied thereto;

FIGS. 9(i a) to 9(*d*) are schematic illustrations of the state of light transmission exhibited by a ferroelectric liquid crystal in relation to the amplitude of a pulse applied thereto;

FIGS. 10(*a*) and 10(*b*) are schematic illustrations showing the state of light transmission exhibited by a bi-stable device in response to a pulse applied;

DESCRIPTION OF THE PREFERRED EMBODIMENTS

According to the present invention having the features set forth above, it is possible to realize a prompt gradation display while compensating for variation in the threshold characteristics. A description will be given of the method of compensating for variation in the threshold value in accordance with the present invention with specific reference to FIG. 1.

Figure 1A:
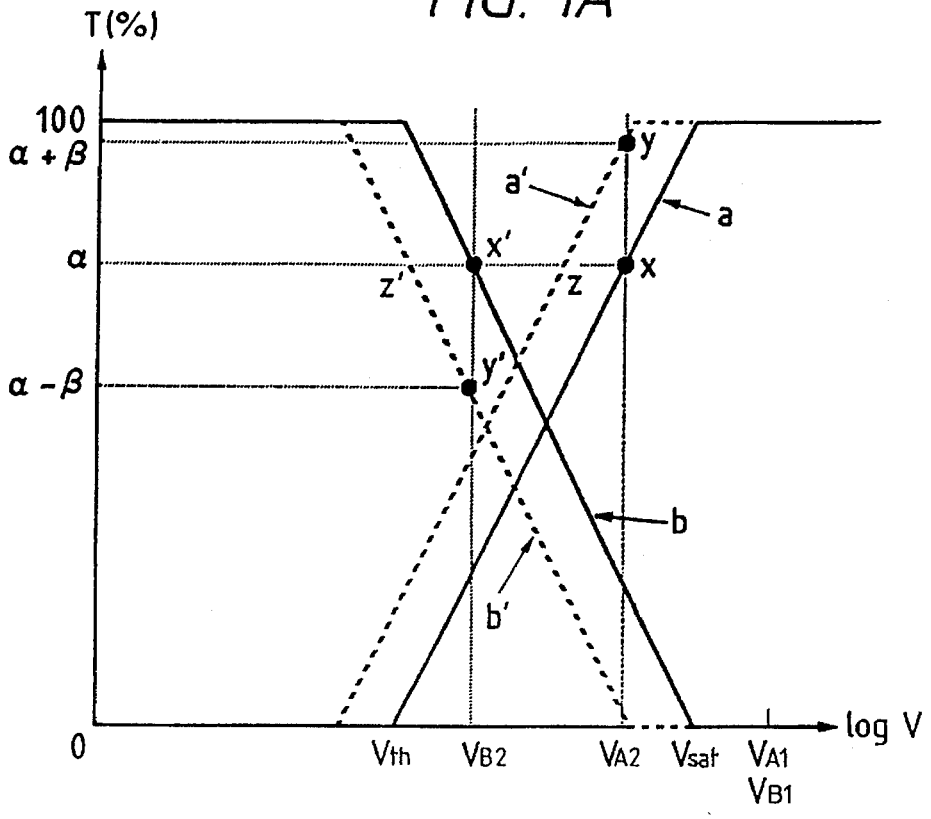
FIGS. 1A to 1C are illustrations of a driving system in accordance with the present invention.
Figure 1B:
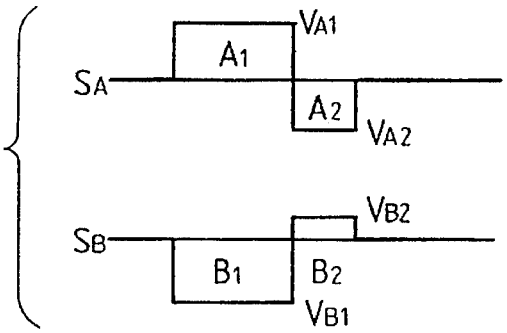
Figure 1C:
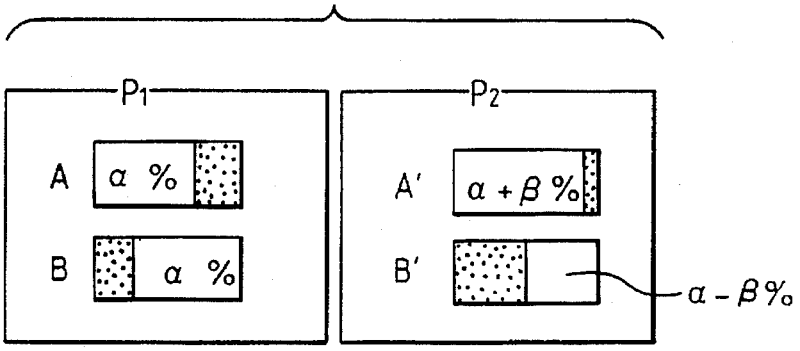

It is assumed here that a pixel $P_1$ is composed of a pair of sub-pixels A and B, while another pixel $P_2$ is composed of a pair of sub-pixels A' and B', as shown in FIG. 1C. It is also assumed that the pixels $P_1$ and $P_2$ have different threshold characteristics as shown in FIG. 1A. More specifically, in FIG. 1A, a curve a shows the threshold characteristic exhibited by the pixel $P_1$ when a white writing pulse is applied thereto, while a curve b shows the threshold characteristic exhibited by the same pixel $P_1$ when a black writing pulse is applied thereto. Similarly, a curve a' shows the threshold characteristic exhibited by the pixel $P_2$ when a white writing pulse is applied thereto, while a curve b' shows the threshold characteristic exhibited by the same pixel $P_2$ when a black writing pulse is applied thereto. A symbol $V_{th}$ indicates the threshold voltage for the threshold characteristics a and b, while $V_{sat}$ indicates the saturation voltage for the threshold characteristics a and b. Light transmissivity 0% indicates that a sub-pixel is in completely light-interrupting or black state, while light-transmissivity 100% indicates that the sub-pixel is in a completely light-transmitting or white state.

Pulses of a waveform $S_A$ shown in FIG. 1B is applied to the sub-pixels A and A' while the sub-pixels B and B' receive pulses of a waveform $S_B$ shown in FIG. 1B.

The waveform $S_A$ is composed of a pulse $A_1$ and a pulse $A_2$. The sub-pixel A is changed into completely black state, i.e., to transmissivity 0%, in response to the black writing pulse $A_1$ and is changed to and maintained at a transmissivity $\alpha$% in response to a white writing pulse $A_2$.

The waveform $S_B$ is composed of a pulse $B_1$ and a pulse $B_2$. The sub-pixel B is changed into completely white state, i.e., to transmissivity 100%, in response to the white writing pulse $B_1$ and is changed to and maintained at a transmissivity $\alpha$% in response to a black writing pulse $B_2$. Consequently, the pixel $P_1$ exhibits a halftone of $\alpha$% in terms of transmissivity as shown in FIG. 1C.

The sub-pixel A' is changed into completely black state, i.e., to transmissivity 0%, in response to the black writing pulse $A_1$ and is changed to and maintained at a transmissivity $\alpha+\beta$% in response to a white writing pulse $A_2$.

The sub-pixel B' is changed into completely white state, i.e., to transmissivity 100%, in response to the white writing pulse $B_1$ and is changed to and maintained at a transmissivity $\alpha-\beta$% in response to a black writing pulse $B_2$. Consequently, the pixel $P_2$ also exhibits a halftone of $\alpha$% in terms of transmissivity as shown in FIG. 1C.

Referring to FIG. 1A, the triangle xyz and the triangle x'y'z' are congruent, because the lengths of the side Xz and x'z' are equal to each other, angle Xzy equals to angle x'y'z' and the angle yxz equals to y'x'z'. Consequently, the condition of $xy=x'y'=\beta$ is met.

The described compensation method is valid on the following conditions:

(1) The threshold value characteristics of each pixel can be substantially approximated by a linear line.

(2) The gradient of the threshold characteristic is maintained unchanged, i.e., the curves representing the threshold characteristics overlap when translationally moved along one of the axes of the coordinate, despite any change in the threshold value or fluctuation of the same in the display area.

(3) The threshold characteristics for the first stable state and the threshold characteristics for the second stable state coincide with each other.

(4) The transmissivity $\alpha$% of the gradation to be displayed and the maximum width $\beta$% of variation of the transmissivity meet the conditions of $\alpha+\beta \leqq 100$ and $\alpha-\beta \leqq 0$.

It has been confirmed in Japanese Patent Application No. 3-73127 mentioned before that a ferroelectric liquid crystal can meet the conditions (1) to (3).

In regard to the condition (1), when the threshold characteristics are completely linear, the following condition is met:

$$\log V_{A2}+\log V_{B2}=\log V_{th}+\log V_{sat}$$

The condition (4) requires that, when the display apparatus has a transmissivity variation of b%, it is possible to uniformly display an image with a gradation within the range between b% and (100–b)%. For instance, when the display apparatus has a transmissivity variation of 10%, it is possible to display an image with analog gradation varying between 10 and 90% in terms of transmissivity. It is also possible to display an image with a digital gradation which varies in a stepped manner at a pitch of 10% in terms of transmissivity. When the display is conducted in digital manner, the threshold characteristics need not be linear but may be stepped as shown in FIGS. 10(*a*) and 10(*b*).

In the embodiment shown in FIGS. 1A to 1C, the gradation is formed by varying the voltage of the driving signals. This, however, is only illustrative and the same effect can be attained by varying the amplitude of the driving pulses while fixing the voltage.

Figure 2:
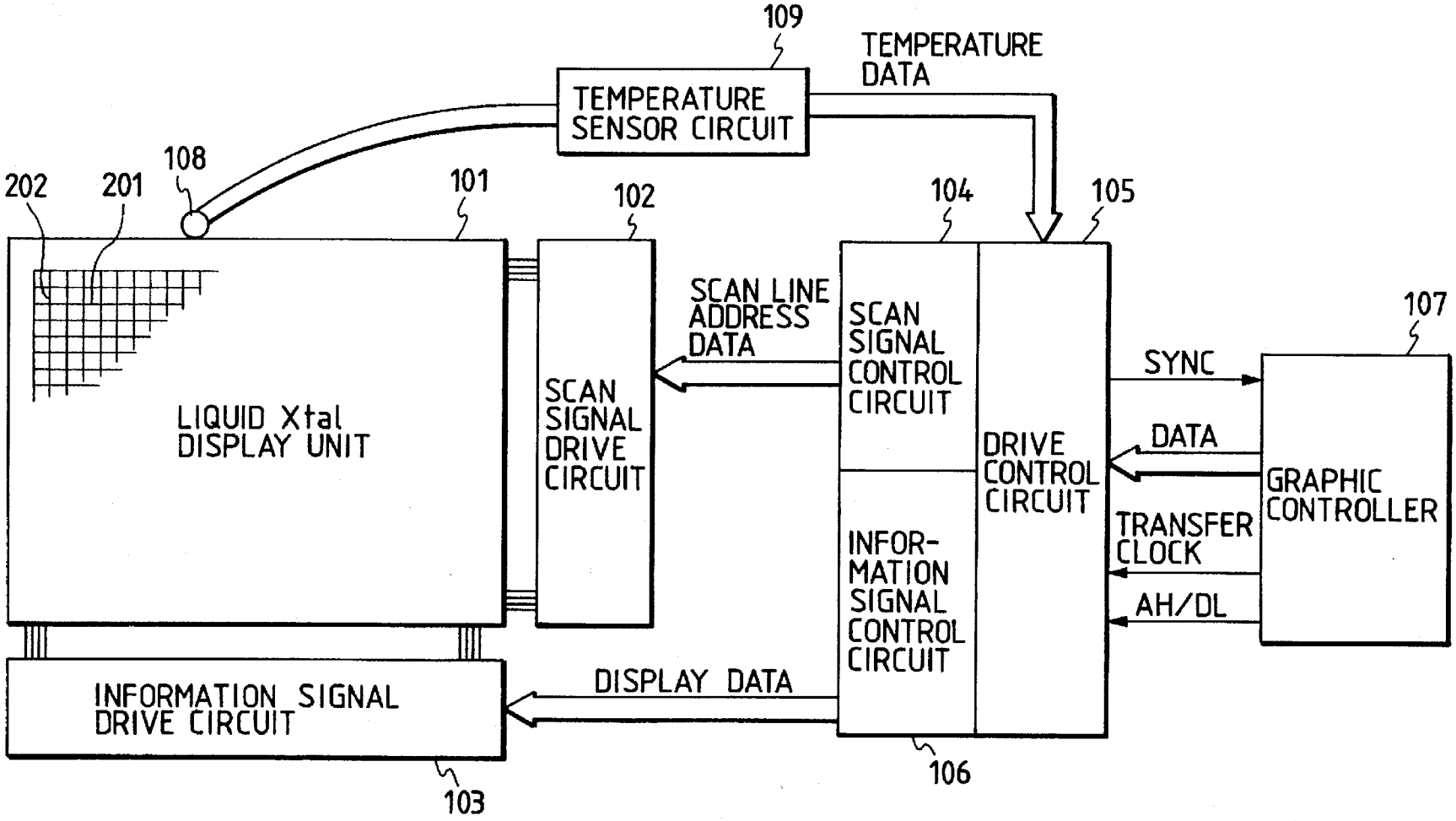
FIG. 2 is an illustration of the construction of an embodiment of the display apparatus of the present invention.

FIG. 2 shows a liquid crystal display apparatus in accordance with an embodiment of the present invention. This display apparatus has a liquid crystal display unit having an electrode matrix composed of scanning electrodes 201 and information electrodes 202 which are detailed in FIG. 3, an information signal drive circuit 103 for applying information signals to the liquid crystal through the information electrodes 202, a scan signal drive circuit 102 for applying scan signals to the liquid crystal through the scanning electrodes 201, a scan signal control circuit 104, an information signal control circuit 106, a drive control circuit 105, a thermistor 108 for detecting the temperature of the display unit 101, and a temperature sensor circuit 109 for sensing the temperature of the display unit 1—1 on the basis of the output of the thermistor 108. A ferroelectric liquid crystal is positioned between the scanning electrode 201 and the information electrode 202. Numeral 107 denotes a graphic controller which supplies data to the scan signal control circuit 104 and the information signal control circuit 106 through the drive control circuit 105 so as to be converted into address data and display data. The temperature of the liquid crystal display unit 101 is delivered to the temperature sensor circuit 109 through the thermistor 108 the output of which is delivered as temperature data to the scan signal control circuit 104 through the drive control circuit 105. The scan signal drive circuit 102 generates a scan signal in accordance with the address data and the temperature data and applies the scan signal to the scanning electrodes 201 of the liquid crystal display unit 101. The information signal drive circuit 103 generates an information signal in accordance with the display data and applies the same to the information electrodes 202 of the liquid crystal display unit 101.

Figure 3:
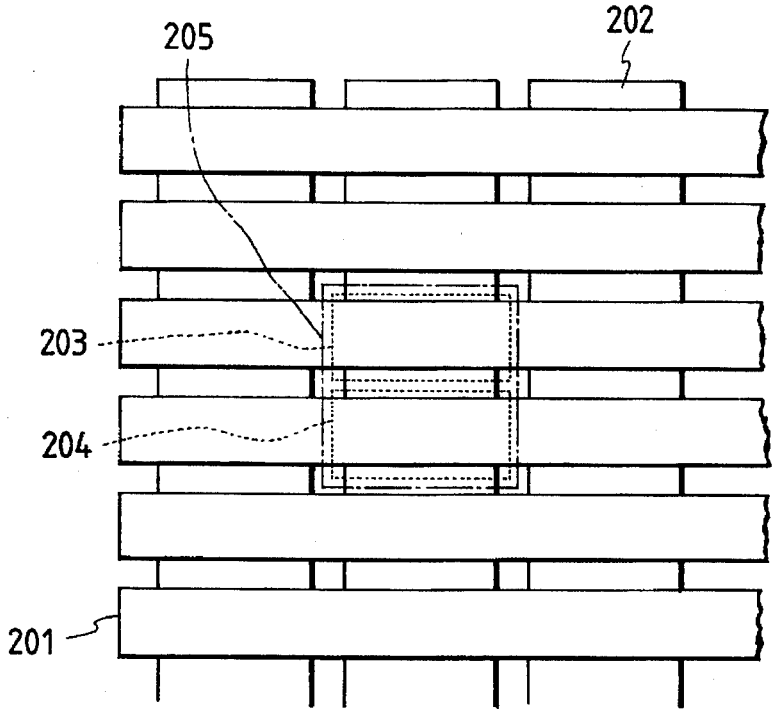
FIG. 3 is an enlarged plan view of a liquid crystal display portion of the display apparatus shown in FIG. 2.

Referring to FIG. 3, numerals 203 and 204 denote sub-pixels which are formed at the points where the scanning electrodes 201 and the information electrodes 202 cross each other. These two sub-pixels 203 and 204 in combination form a pixel which is an element of the display.

Figure 4:
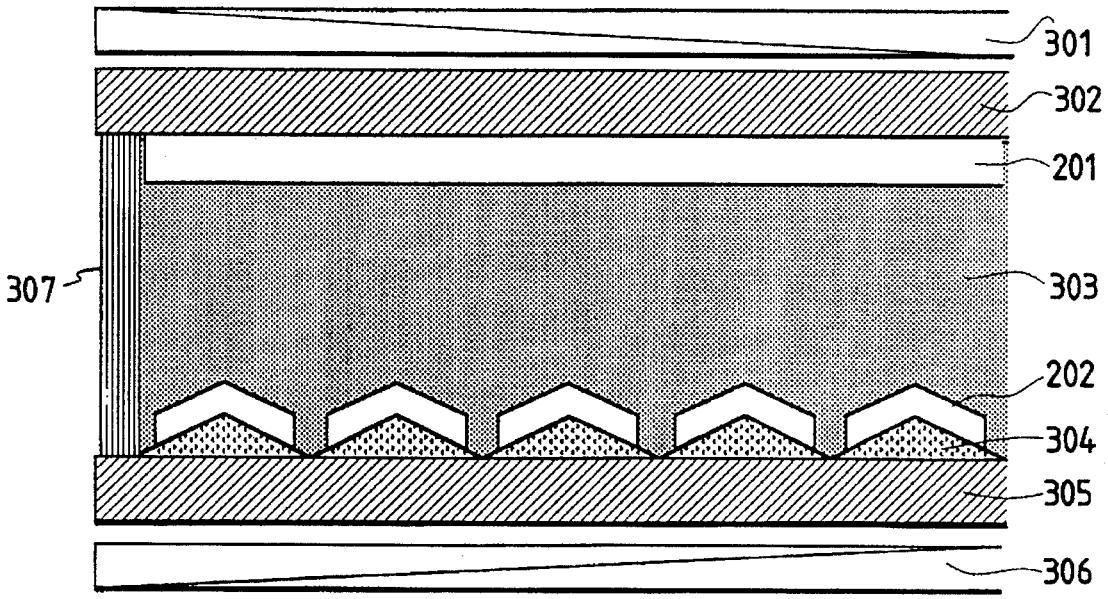
FIG. 4 is a sectional view of the liquid crystal display portion shown in FIG. 3.

FIG. 4 is a fragmentary sectional view of the liquid crystal display unit 101. An analyzer 301 and a polarizer 306 are arranged in a cross-nicol relation to each other. Numerals 302 and 305 denote glass substrates, 303 denotes a layer of the ferroelectric liquid crystal, 304 denotes a UV set resin and 307 denotes a spacer.

Figure 5:
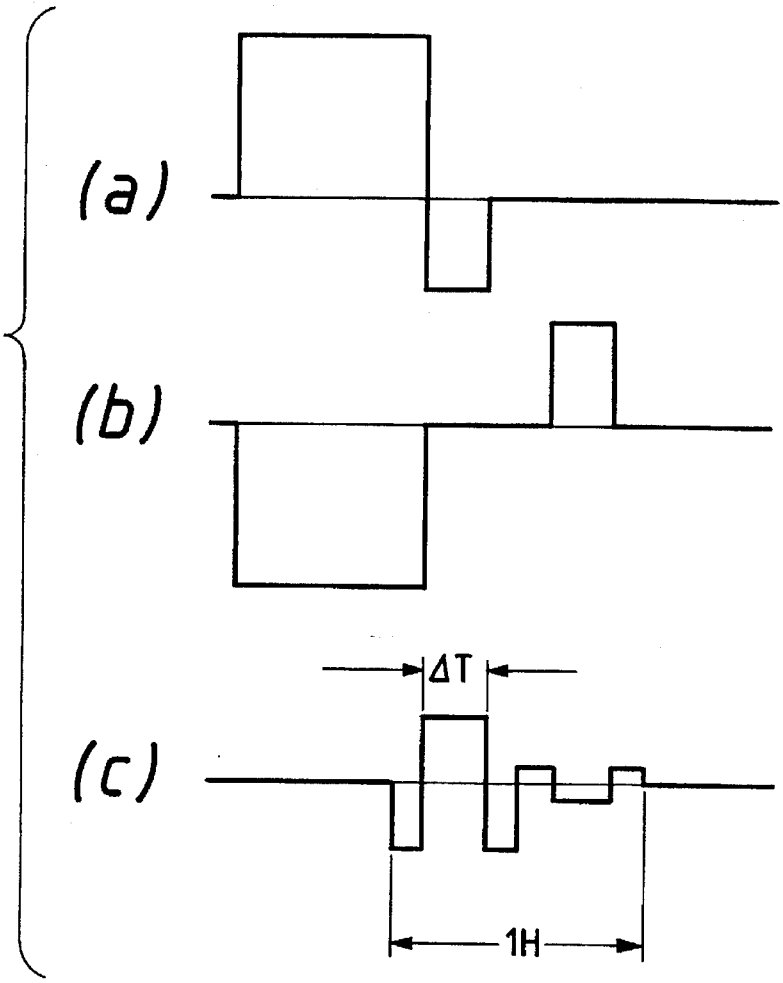
FIGS. 5(*a*) to 5(*c*) are signal charts showing the waveforms of driving signals employed in the apparatus shown in FIG. 1.

FIGS. 5(*a*) to 5(*c*) show waveforms of drive signals employed in the apparatus shown in FIG. 2. More specifically, FIG. 5(*a*) shows a selection signal which is generated by the scan signal drive circuit 102 and applied to the first sub-pixel, FIG. 5(*b*) shows a selection signal applied to the second sub-pixel by the scan signal drive circuit 102 in synchronization with the signal of FIG. 5(*a*), and FIG. 5(*c*) represents an information signal which is produced by the information signal drive circuit 103 and which has an amplitude corresponding to the gradation data. As will be seen from FIG. 5(*c*), the time 1H required for driving one pixel for display is as short as 4 times the width of the second pulse, i.e., 4Δt.

Although in the described embodiment the gradation display is performed by varying the amplitude of the pulse while fixing the width of the pulse, this is only illustrative and an equivalent effect can be obtained by varying the pulse width while fixing the amplitude of the pulse.

In the illustrated embodiment, a gradient is imparted to the cell thickness in order to obtain a gentle threshold characteristic in the pixel. This, however, is not exclusive and an equivalent effect can be obtained by using an alternative measure such as a gradient of capacitance or a gradient of electrical potential of the electrode.

Figure 6:
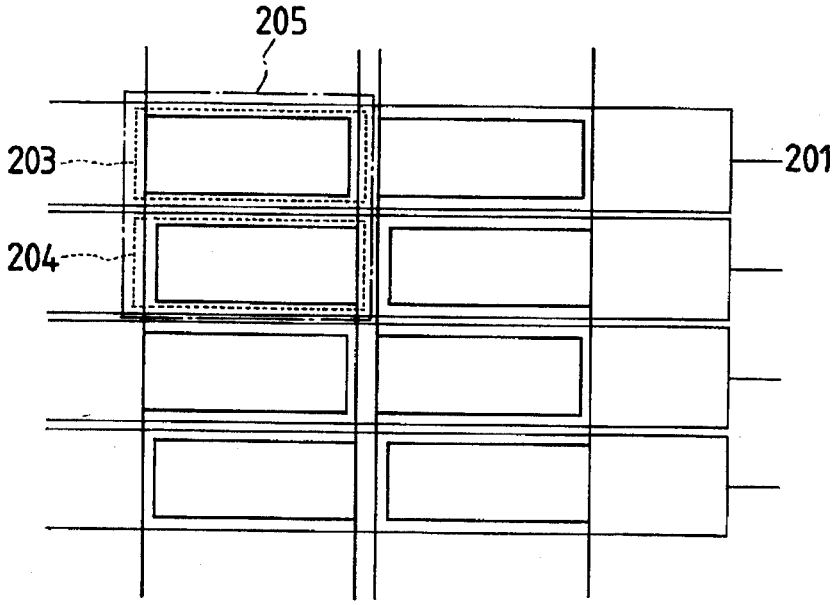
FIG. 6 is an enlarged plan view of a liquid crystal display portion of another embodiment of the present invention.
Figure 11A:
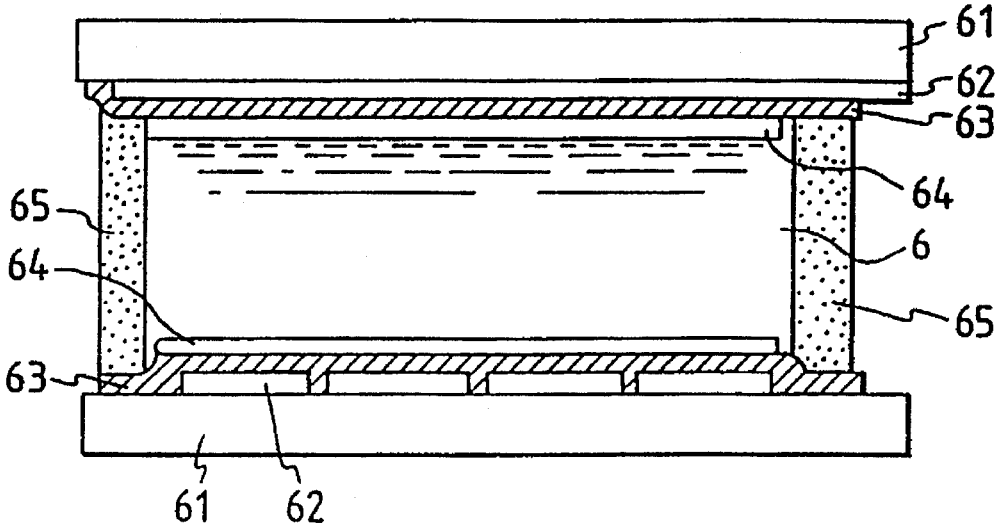
FIG. 11A PRIOR ART
FIGS. 11(*a*) and 11(*b*) are illustrations of the construction of a conventional liquid crystal device.
Figure 11B:
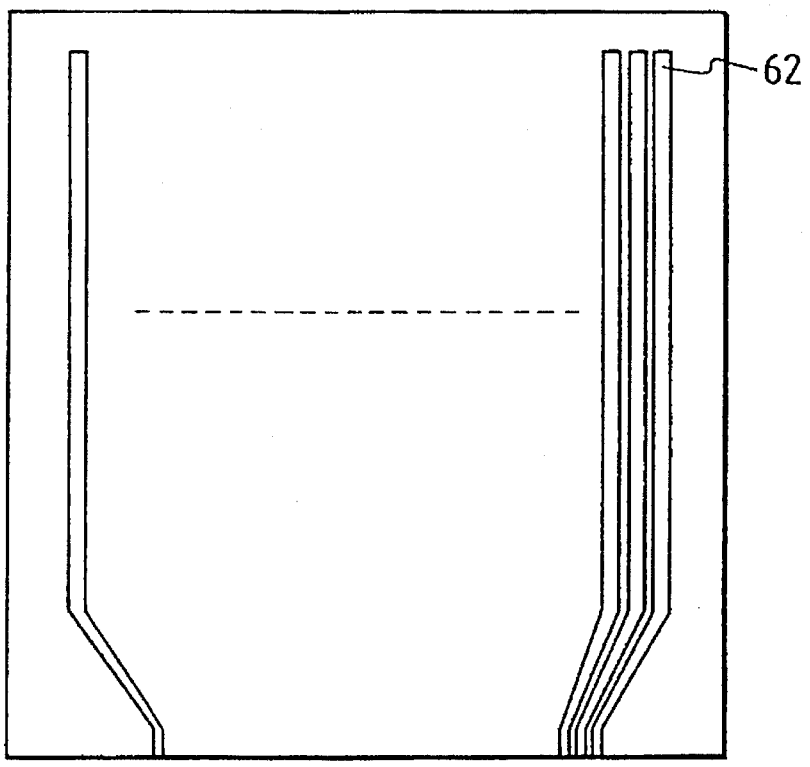
FIG. 11B PRIOR ART

FIG. 6 shows an embodiment having an electrode structure which is different from that of the embodiment described above. Namely, while in the embodiment shown in FIG. 3 the pair of sub-pixels 203 and 204 are formed on the points where two different scanning electrodes 201, 201 cross a common information electrode 202, the sub-pixels in the embodiment shown in FIG. 6 belong to different scanning electrodes 601 and different information electrodes 602. FIGS. 7(*a*) to 7(*d*) show waveforms of drive signals used in this embodiment. More specifically, FIG. 7(*a*) shows the waveform of the scan selection signal applied to the first sub-pixel, FIG. 7(*b*) shows the waveform of the scan selection signal applied to the second sub-pixel, FIGS. 7(*c*) and 7(*d*) show, respectively, the waveforms of information signals applied to the first and second sub-pixels. As will be seen from FIGS. 7(*c*) and 7(*d*), the time 1H required for one pixel to perform display is as small as twice that of the width of the second writing pulse, i.e., 2Δt, which is the same as that required for conventional monochromatic binary display and half the time required in the embodiment shown in FIG. 3.

According to the present invention, it is possible to realize a prompt display of information with gradation while compensating for variation in the threshold characteristics. A description will now be given of the method of compensation for variation in the threshold value in accordance with the present invention, with specific reference to FIGS. 12A to 12C.

It is assumed here that a display area contains pixels $P_A$, $P_B$, $P_C$, $P_D$ and $P_E$ which are respectively composed of two sub-pixels $A_1$, $A_2$, $B_1$, $B_2$, $C_1$, $C_2$, $D_1$, $D_2$ and $E_1$, $E_2$. As will be seen from FIGS. 12C and 12A, the pixel $P_A$ has the highest threshold level among the pixels and other pixels $P_B$, $P_C$, $P_D$ and $P_E$ have threshold value decreasing in the mentioned order.

Figure 12A:
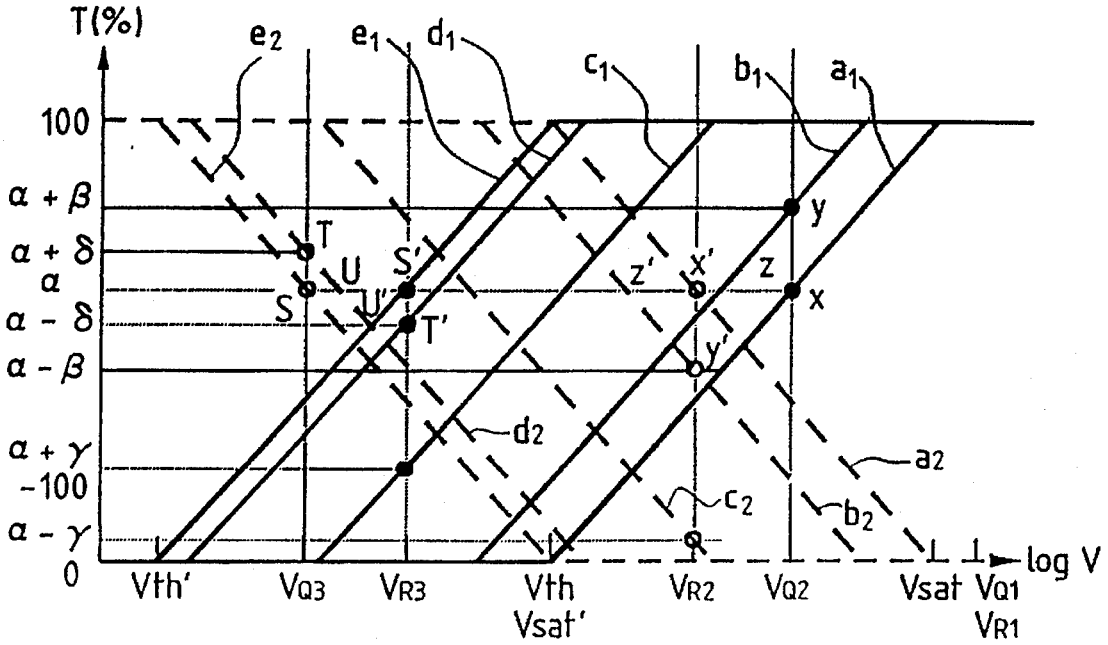
FIGS. 12A to 12C are illustrations of the driving method in accordance with the present invention.

Referring to FIG. 12A, $a_1$ and $a_2$ represent the threshold characteristics for white writing pulse and black writing pulse for the pixel $P_A$, $b_1$ and $b_2$ represent the threshold characteristics for white writing pulse and black writing pulse for the pixel $P_B$, $c_1$ and $c_2$ represent the threshold characteristics for white writing pulse and black writing pulse for the pixel $P_C$, $d_1$ and $d_2$ represent the threshold characteristics for white writing pulse and black writing pulse for the pixel $P_D$, and $e_1$ and $e_2$ represent the threshold characteristics for white writing pulse and black writing pulse for the pixel $P_E$, respectively. Symbol $V_{th}$ represents the threshold voltage of the threshold characteristics $a_1$, $a_2$, while $V_{sat}$ represents the saturation voltage of the threshold characteristics $a_1$, $a_2$. Symbol $V_{th}'$ represents the threshold voltage of the threshold characteristics $e_1$, $e_2$, while $V_{sat}'$ represents the saturation voltage of the threshold characteristics $e_1$, $e_2$. Completely black state of a sub-pixel is represented by transmissivity 0%, while transmissivity 100% indicates that the sub-pixel is in completely white state.

Signals of waveforms Q and R shown in FIG. 12A are applied to the sub-pixels $A_1$ to $E_1$ and sub-pixels $A_2$ to $E_2$, respectively.

The waveform Q is composed of pulses $Q_1$, $Q_2$ and $Q_3$. The pulse $Q_1$ is a black pulse which turns all the pixels into the black state of 0% in terms of transmissivity, the pulse $Q_2$ is a white writing pulse which turns the sub-pixel $A_1$ into a state of α% in terms of transmissivity and the pulse $Q_3$ is a black writing pulse which realizes the transmissivity of α% in the sub-pixel $E_1$ whose saturation voltage $V_{sat}'$ equals to the threshold voltage $V_{th}$ of the sub-pixel $A_1$.

The waveform R is composed of pulses $R_1$, $R_2$ and $R_3$. The pulse $R_1$ is a white writing pulse which turns all the pixels into the white state of 100% in terms of transmissivity, the pulse $R_2$ is a black writing pulse which turns the sub-pixel $A_2$ into a state of α% in terms of transmissivity and the pulse $R_3$ is a white writing pulse which realizes the transmissivity of α% in the sub-pixel $E_1$ whose saturation voltage $V_{sat}'$ equals to the threshold voltage $V_{th}$ of the sub-pixel $A_2$.

If the transmissivity of the sub-pixel $B_1$ realized by the pulse $Q_2$ is α+β%, the transmissivity of the sub-pixel $B_2$ created by the pulse $R_2$ is α−β%, for the reason stated below.

Namely, referring to FIG. 12A, two triangles xyz and x'y'z' are congruent to each other because the angle yxz equals to the angle y'x'z' and smaller than a right angle R, the angle xzy equals to the angle x'z'y' and the length of the side xz equals to the length of the size x'z'. Therefore, the lengths of the sides xy and x'y' are equal to each other and to β.

Similarly, if the transmissivity of the sub-pixel $D_1$ realized by the pulse $Q_3$ is α+δ%, the transmissivity of the sub-pixel $D_2$ created by the pulse $R_3$ is α−δ%. This is proved by the fact that the triangles STU and S'T'U' are congruent to each other.

Figure 13:
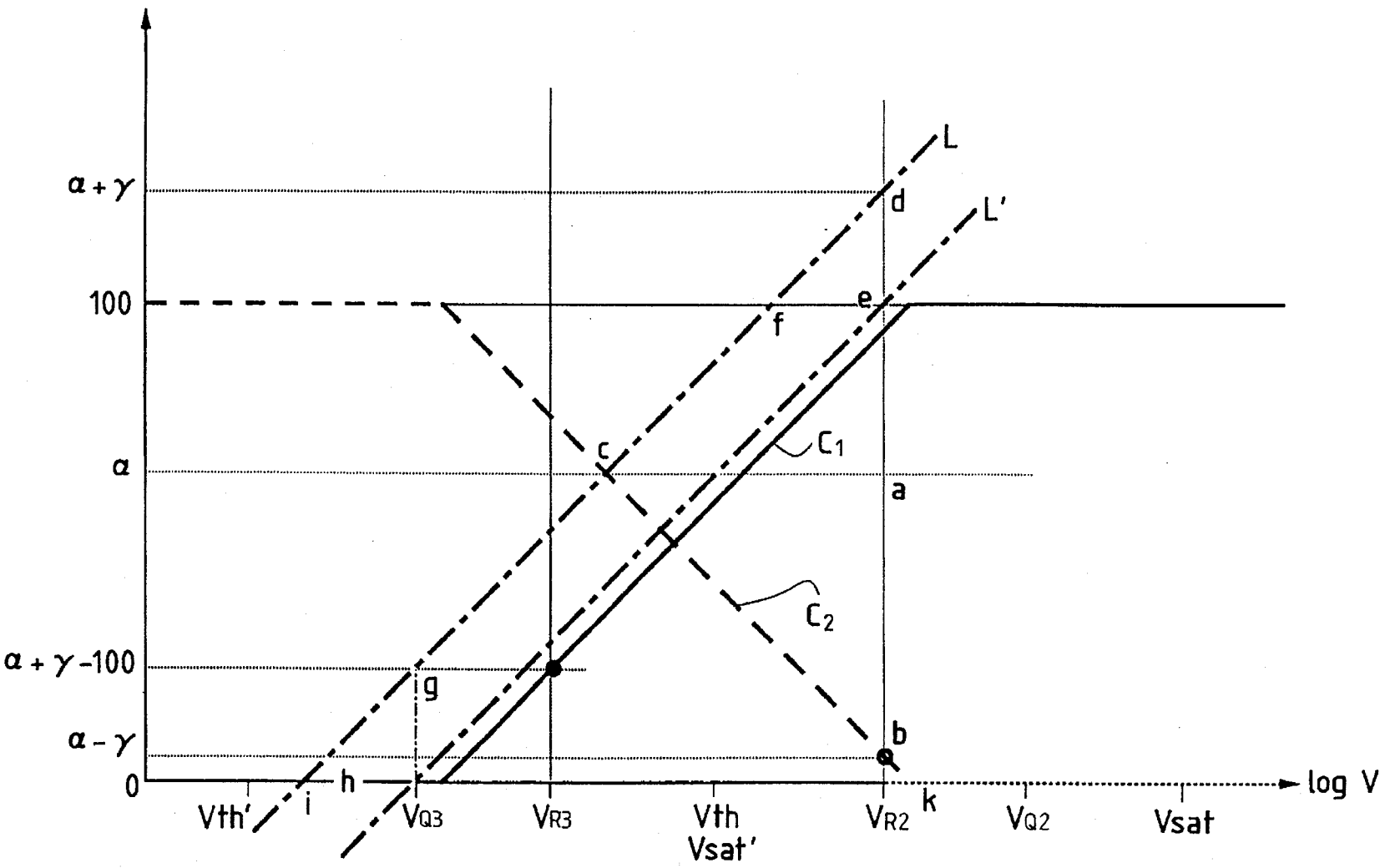
FIG. 13 is an illustration of a detail of the light-transmission compensation shown in FIG. 12A.

It is also clear from FIG. 13 that, if the transmissivity of the sub-pixel $C_1$ created by the pulse $R_2$ is α−γ(>0) %, the transmissivity can be further increased by α+γ−100% by the application of the pulse $R_3$.

More specifically, referring to FIG. 13, adjoint lines are added including a line L which passes the point c and parallel to the line cl, a line L' passing the point e and parallel to the line cl and a line which is drawn from the point g normally to the voltage axis. It will be understood that the triangle abc is congruent to the triangle adc and that the triangle def is congruent to the triangle ghi. Since the triangle abc is congruent to the triangle adc, the lengths of the sides ab and ad are equal to each other and to γ. In addition, since the length of the side ak equals to α, the length of the side dk is represented by α+γ. Furthermore, since the length of the side ek is 100, a condition of de=dk−ek=α+γ−100 is met. Furthermore, since the triangle def is congruent to the triangle ghi, the length of the side de equals that of the side gh. Consequently, the length of the side gh is given by gh=α+γ−100.

Thus, the compensation method in accordance with the present invention is valid on the following four conditions:

(1) The threshold characteristics of each pixel can be substantially approximated by a straight line.

(2) The gradient of the threshold characteristics is not changed despite any change of the threshold value or variation of the threshold value within the display area so that curves representing the threshold characteristics of the same pixel overlap when they are translationally moved along an axis of the coordiante.

(3) The threshold characteristics for the first stable state and the threshold characteristics for the second stable state coincide with each other.

(4) The highest threshold voltage $V_{th}$ and the lowest saturation voltage $V_{sat}$ of the pixels within the display area meet the condition of $V_{th} \leqq V_{sat}$.

It has been confirmed in the aforementioned Japanese Patent Application No. 3-73127 that a ferroelectric liquid crystal can meet the conditions (1) to (3) mentioned above.

Figure 12B:
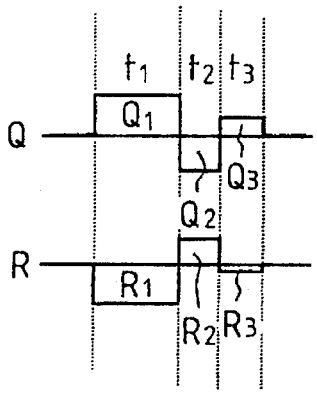

The condition (4) is posed when three writing pulses are employed for writing in a single sub-pixel. When five pulses are used, the condition is $V_{th} \leqq 2V_{sat}$ and, when seven pulses are employed, the condition iS $V_{th} \leqq 4V_{sat}$. In other words when three pulses are employed as shown in FIG. 12B, it is possible to compensate for variation in the threshold voltage or the saturation voltage provided that the amount of variation is within two times. Similarly, when five or seven pulses are employed, compensation is possible when the amount of variation is within 3 times and 5 times, respectively.

Referring to the condition (1), when the threshold characteristics are completely linear, the following conditions are met:

$$\log V_{Q2} + \log V_{R2} = \log V_{th} + \log V_{sat}$$

$$\log V_{Q2} + \log V_{Q3} = \log V_{R2} + \log V_{R3} = 2 \times \log V_{th}$$

Figure 12C:
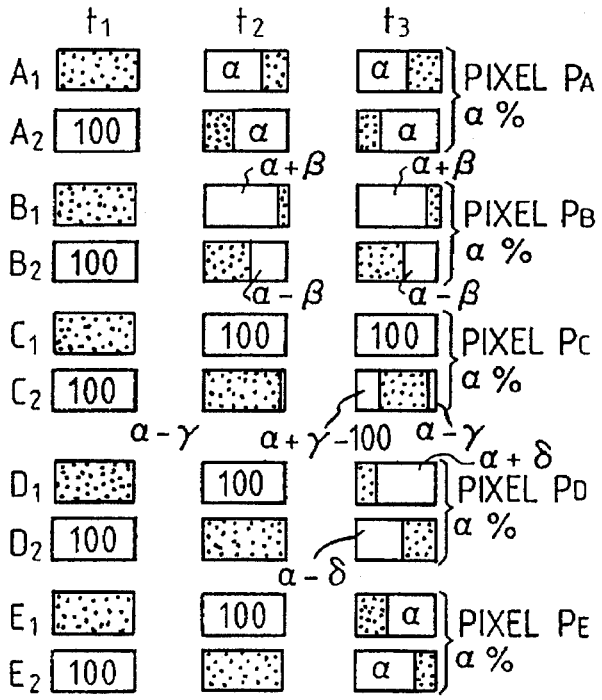

In the embodiment explained in connection with FIGS. 12A to 12C, the gradation display is performed by varying the voltage of the pulses applied. This, however, is not essential and the same effect can be obtained when the pulse widths are controlled while the voltages are fixed. Furthermore, when the gradation display is to be performed digitally, it is not always necessary that the threshold characteristics are linear. Namely, in such a case, the threshold characteristics may be stepped as shown in FIG. 10.

Figure 14:
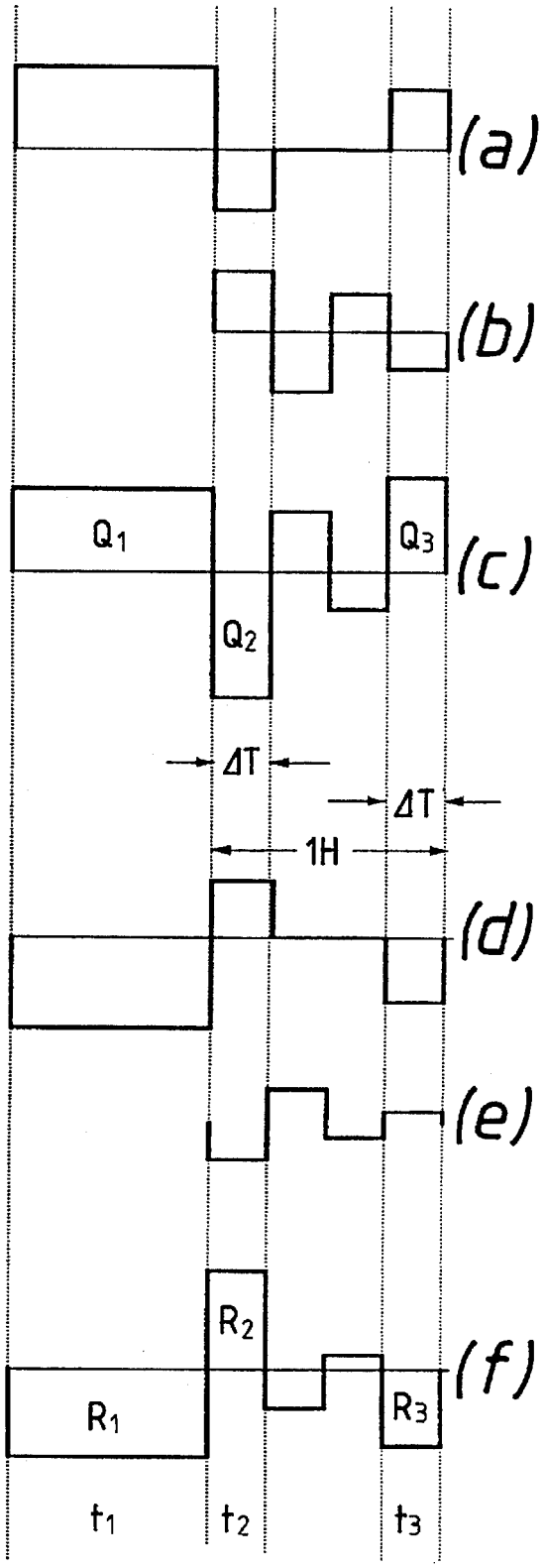
FIGS. 14(*a*) to 14(*f*) are signal charts illustrating waveforms of driving signal employed in the apparatus shown in FIG. 2.

FIGS. 14(*a*) to 14(*f*) show waveforms of drive signals employed in the apparatus shown in FIG. 2. More specifically, FIG. 14 (*a*) shows a selection signal which is generated by the scan signal drive circuit 102 and applied to the first sub-pixel, FIG. 14(*b*) shows an information signal which is produced by the information signal drive circuit 103 and which has an amplitude corresponding to the gradation data. FIG. 14(*c*) shows a composite waveform composed of the waveforms of FIGS. 14(*a*) and 14(*b*). FIG. 14(*d*) shows the waveform of the selection signal which is applied to the second sub-pixel by the scan signal drive circuit 102. FIG. 14(*e*) shows the waveform of the information signal which is applied to the second sub-pixel by the information signal drive circuit 103 and which has an amplitude corresponding to the gradation data. FIG. 14(*f*) shows the composite waveform composed of the waveforms shown in FIGS. 14(*d*) and 14(*e*). Symbols t1 to t3, Q1 to Q3 and R1 to R3 represent the same pulse widths and pulses as those shown in FIG. 12B.

As will be seen from these Figures, the time 1H required for driving one pixel for display is as short as 4 times the width of the second and subsequent writing pulses, i.e., 4Δt.

Although in the described embodiment the gradation display is performed by varying the amplitude of the pulse while fixing the width of the pulse, this is only illustrative and an equivalent effect can be obtained by varying the pulse width while fixing the amplitude of the pulse.

In the illustrated embodiment, a gradient is imparted to the cell thickness in order to obtain a gentle threshold characteristic in the pixel. This, however, is not exclusive and an equivalent effect can be obtained by using an alternative measure such as a gradient of capacitance or a gradient of electrical potential of the electrode.

As has been described, according to one aspect of the present invention, there is provided a display apparatus, comprising: a display section having a multiplicity of pixels arranged in the form of a matrix, each pixel having first and second bi-stable sub-pixels which have the same threshold characteristics; and driving means for driving the pixels in such a manner that a first writing pulse is applied to the first sub-pixel so as to write a complete first stable state in the first sub-pixel, followed by application of a second writing pulse to write the second stable state, while a first writing pulse is applied to the second sub-pixel to write a complete second stable state in the second sub-pixel, followed by application of a second writing pulse to write the first stable state. With this arrangement, it is possible to realize a prompt display of information with gradation while compensating for any variation in the threshold voltage attributable to variation in the temperature or cell thickness in the display unit.

According to another aspect of the invention, there is provided a A display apparatus, comprising: a display section having a multiplicity of pixels arranged in the form of a matrix, each pixel having first and second bi-stable sub-pixels which have the same threshold characteristics; and driving means for driving the pixels by applying a plurality of writing pulses to each of the first and second sub-pixels in such a manner that a first writing pulse is applied to the first sub-pixel so as to write a complete first stable state in the first sub-pixel, followed by application of second and subsequent writing pulses to alternately write the second stable state and the first stable state, while a first writing pulse is applied to the second sub-pixel to write a complete second stable state in the second sub-pixel, followed by application of second and subsequent writing pulses to alternately write the first stable state and the second stable state. This arrangement also makes it possible to obtain a prompt display of information with gradation while compensating for any variation in the threshold voltage attributable to variation in the temperature or cell thickness in the display unit.

What is claimed is:

1. A display apparatus comprising:

a display section, having a plurality of driving points, comprising first and second electrode sections disposed opposite to each other and having a liquid crystal sandwiched therebetween, wherein a first polarity pulse is applied to first driving points to set the first driving points entirely at one optical state, a second polarity pulse opposite to the first polarity pulse is applied to the first driving points to set the first driving points at a state of transmissivity $\alpha\%$, a third polarity pulse opposite to the first polarity pulse is applied to second driving points to set the second driving points at the other optical state, a fourth polarity pulse of the same polarity as the first polarity pulse is applied to the second driving points to set the second driving points at a state of transmissivity $\alpha\%$, the first polarity pulse is applied to third driving points to set the third driving points entirely at the one optical state, the second polarity pulse opposite to the first polarity pulse is applied to the third driving points at a state of transmissivity $(\alpha+\beta)\%$, the third polarity pulse opposite to the first polarity pulse is applied to fourth driving points to set the fourth driving points at the other optical state, and the fourth polarity pulse of the same polarity as the first polarity pulse is applied to the fourth driving points to set the fourth driving points at a state of transmissivity $(\alpha-\beta)\%$; and voltage signal applying means for applying a first voltage signal of one polarity to the first and the third driving points entirely to set the first and the third driving points at the one optical state, for applying a second voltage signal opposite to the first voltage signal to the first and the third driving points in response to information, so that the first driving points are set at a state of transmissivity $\alpha\%$ and the third driving points are set at a state of transmissivity $(\alpha+\beta)\%$, for applying a third voltage signal of an opposite polarity to the second and the fourth driving points entirely to set the second and the fourth driving points at the other optical state, and for supplying a fourth voltage signal opposite to the third voltage signal to the second and the fourth driving points in response to information, so that the second driving points are set at a state of transmissivity $\alpha\%$ and the fourth driving points are set at a state of transmissivity $(\alpha-\beta)\%$, thereby equalizing a transmissivity of a pixel composed of the first driving points and the second driving points with a transmissivity of a pixel composed of the third driving points and the fourth driving points.

2. A display apparatus according to claim 1, wherein the plurality of driving points are arranged along plural rows and columns to form a display matrix.

3. A display apparatus according to claim 1, wherein said liquid crystal is a chiral smectic liquid crystal.

* * * * *

UNITED STATES PATENT AND TRADEMARK OFFICE

CERTIFICATE OF CORRECTION

PATENT NO. : 5,654,732

DATED : August 5, 1997

INVENTOR(S) : Katakura

It is certified that error appears in the above-identified patent and that said Letters Patent is hereby corrected as shown below:

COLUMN 7:

Line 25, "to" should be deleted.
Line 64, "coordiante." should read --coordinate.--.

COLUMN 8:

Line 10, "iS" should read --is--.

Signed and Sealed this

Nineteenth Day of May, 1998

Bruce Lehman

*Attest:*

BRUCE LEHMAN

*Attesting Officer*

*Commissioner of Patents and Trademarks*